US007520504B2

(12) United States Patent
Matsutomo et al.

(10) Patent No.: US 7,520,504 B2
(45) Date of Patent: Apr. 21, 2009

(54) PAPER PROCESSING DEVICE, PAPER PROCESSING METHOD AND IMAGE FORMING APPARATUS

(75) Inventors: Yasushi Matsutomo, Nara (JP); Haruo Sayama, Yamatokoriyama (JP); Kiwamu Morita, Osaka (JP); Michihiro Yamashita, Nara (JP); Yuriko Kamei, Nara (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 189 days.

(21) Appl. No.: 11/555,298

(22) Filed: Nov. 1, 2006

(65) Prior Publication Data

US 2007/0102874 A1 May 10, 2007

(30) Foreign Application Priority Data

Nov. 9, 2005 (JP) ..... 2005-325382

(51) Int. Cl.
*B65H 31/00* (2006.01)

(52) U.S. Cl. ..... 271/207; 414/791.2

(58) Field of Classification Search ..... 414/791.2; 271/207

See application file for complete search history.

(56) References Cited

U.S. PATENT DOCUMENTS 4,989,853 A * 2/1991 Matysek et al. ..... 270/58.3
5,007,625 A * 4/1991 Kremers et al. ..... 270/58.01
5,037,081 A * 8/1991 Engelhardt et al. ..... 271/207
5,316,287 A * 5/1994 Hiroi et al. ..... 271/213
5,513,839 A * 5/1996 Green ..... 270/58.07
6,341,934 B1 * 1/2002 Takeno et al. ..... 414/791.2
6,371,472 B1 * 4/2002 Miyake et al. ..... 270/58.14
6,485,010 B1 * 11/2002 Lamothe ..... 270/52.09
6,626,428 B2 * 9/2003 Soga et al. ..... 271/182
6,659,455 B2 * 12/2003 Endo et al. ..... 271/220
6,719,522 B1 * 4/2004 Gunther ..... 414/791.2
6,832,759 B2 * 12/2004 Nagasako et al. ..... 271/222
6,871,851 B2 * 3/2005 Tamura et al. ..... 271/221
7,014,183 B2 * 3/2006 Tamura et al. ..... 270/58.09
7,216,865 B2 * 5/2007 Tamura et al. ..... 271/207
7,300,052 B2 * 11/2007 Tamura et al. ..... 271/221
2002/0159877 A1 * 10/2002 Chen ..... 414/791.2
2004/0145112 A1 * 7/2004 Matsutomo et al. ..... 271/207

FOREIGN PATENT DOCUMENTS

JP 2002-154734 5/2002
JP 2005-350187 12/2005

* cited by examiner

*Primary Examiner*—Patrick H Mackey
*Assistant Examiner*—Prasad V Gokhale
(74) *Attorney, Agent, or Firm*—Renner, Otto, Boisselle & Sklar, LLP

(57) ABSTRACT

A paper processing device includes a processing unit, a paper ejection roller, a sorting mechanism, a paper overlapping mechanism, and a control unit. The processing unit performs predetermined processing upon sheets of paper being conveyed one at a time along a paper conveyance direction. The roller discharges the sheets in the paper conveyance direction, after completion of processing by the processing unit. The sorting mechanism shifts the roller to and fro between an initial position and a sorting position in a direction orthogonal to the paper conveyance direction. The overlapping mechanism superimposes, between the processing unit and the roller in the paper conveyance direction, a predetermined number of sheets of paper upon which processing has been completed. The control unit superimposes a predetermined number of sheets of paper by operating the overlapping mechanism, before shifting the roller from the initial position to the sorting position with the sorting mechanism.

10 Claims, 11 Drawing Sheets

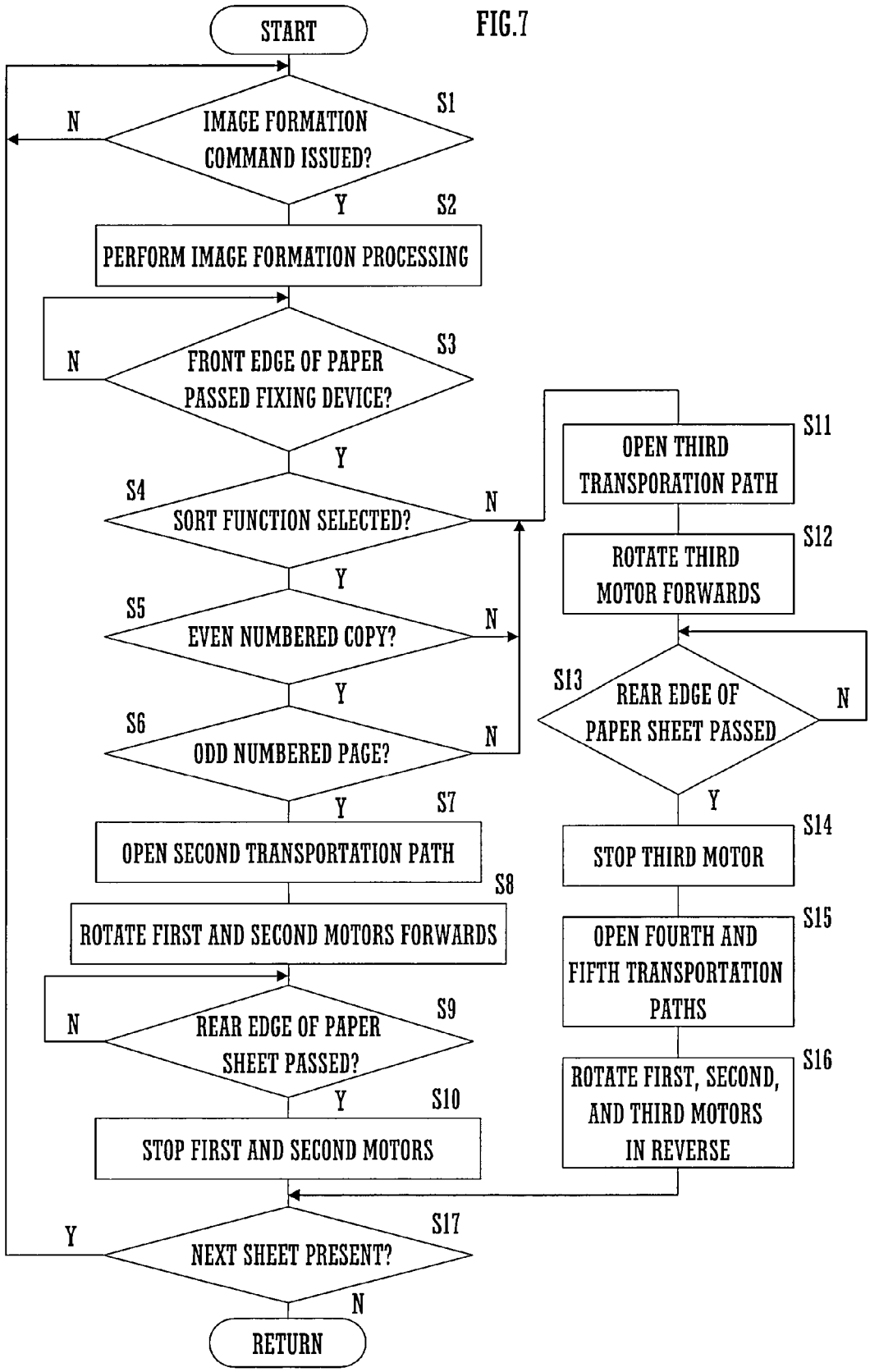
FIG.7
START
S1
IMAGE FORMATION COMMAND ISSUED?
N
Y
S2
PERFORM IMAGE FORMATION PROCESSING
S3
FRONT EDGE OF PAPER PASSED FIXING DEVICE?
N
Y
S4
SORT FUNCTION SELECTED?
N
Y
S5
EVEN NUMBERED COPY?
N
Y
S6
ODD NUMBERED PAGE?
N
Y
S7
OPEN SECOND TRANSPORTATION PATH
S8
ROTATE FIRST AND SECOND MOTORS FORWARDS
S9
REAR EDGE OF PAPER SHEET PASSED?
N
Y
S10
STOP FIRST AND SECOND MOTORS
S11
OPEN THIRD TRANSPORATION PATH
S12
ROTATE THIRD MOTOR FORWARDS
S13
REAR EDGE OF PAPER SHEET PASSED
N
Y
S14
STOP THIRD MOTOR
S15
OPEN FOURTH AND FIFTH TRANSPORTATION PATHS
S16
ROTATE FIRST, SECOND, AND THIRD MOTORS IN REVERSE
S17
NEXT SHEET PRESENT?
Y
N
RETURN

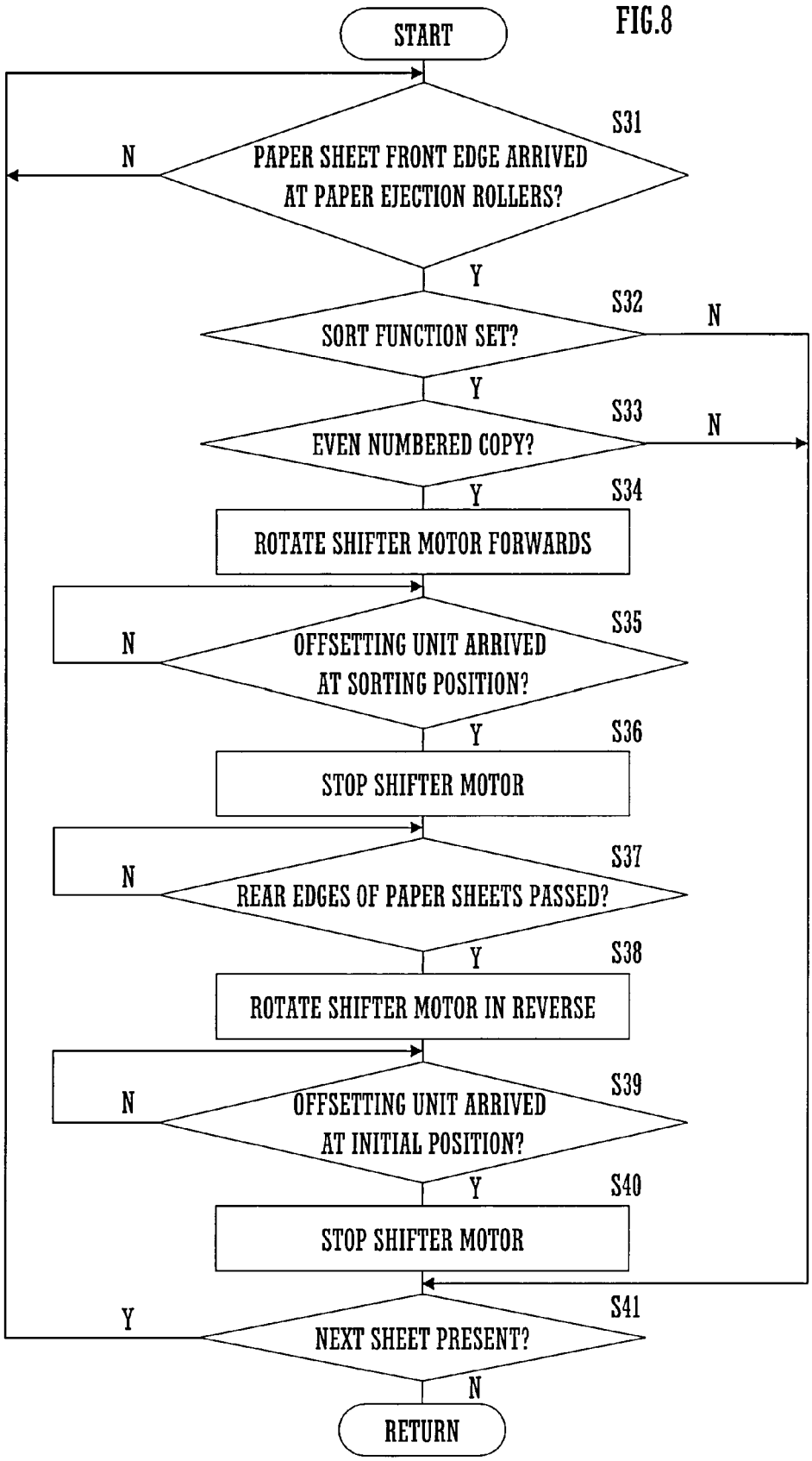
FIG.8
START
S31
PAPER SHEET FRONT EDGE ARRIVED AT PAPER EJECTION ROLLERS?
N
Y
S32
SORT FUNCTION SET?
N
Y
S33
EVEN NUMBERED COPY?
N
Y
S34
ROTATE SHIFTER MOTOR FORWARDS
S35
OFFSETTING UNIT ARRIVED AT SORTING POSITION?
N
Y
S36
STOP SHIFTER MOTOR
S37
REAR EDGES OF PAPER SHEETS PASSED?
N
Y
S38
ROTATE SHIFTER MOTOR IN REVERSE
S39
OFFSETTING UNIT ARRIVED AT INITIAL POSITION?
N
Y
S40
STOP SHIFTER MOTOR
S41
NEXT SHEET PRESENT?
Y
N
RETURN

PAPER PROCESSING DEVICE, PAPER PROCESSING METHOD AND IMAGE FORMING APPARATUS

CROSS REFERENCE

This Nonprovisional application claims priority under 35 U.S.C. §119(a) on Patent Application No. 2005-325382 filed in Japan on Nov. 9, 2005, the entire contents of which are hereby incorporated by reference.

BACKGROUND OF THE INVENTION

The present invention relates to a paper processing device, a paper processing method, and an image forming apparatus which discharge paper sheets upon which predetermined processing has been performed while sorting them into a plurality of positions along a direction which is orthogonal to the direction of paper conveyance.

As is disclosed, for example, in Japanese Laid-Open Patent Publication 2002-154734, in a paper processing device such as an image forming apparatus or the like, it is per se known to provide a sorting mechanism which discharges a plurality of sheets of paper upon which processing has been completed while sorting them into a plurality of positions along a direction which is orthogonal to the direction of paper conveyance. Such a sorting mechanism is termed a shifter mechanism, and it shifts paper ejection rollers which discharge paper in the paper conveyance direction to and fro in the direction orthogonal to the paper conveyance direction, between an initial position and a sorting position. By doing this, the pages of a plurality of copies of a multi-page document upon which processing has been completed are stored in a paper ejection tray, sorted into the individual copies.

As one example, when discharging a page of the (2n−1)th copy (where n=1, 2, 3, . . . ), the sorting mechanism may station the paper ejection rollers in their initial position. And, when discharging a page of the (2n)th copy, after the end portion of the paper sheet has passed the paper ejection rollers which are positioned in their initial position, the sorting mechanism may shift the paper ejection rollers to the sorting position while keeping them in the state in which they are sandwiching the paper sheet between them, and then discharge the paper sheet.

In order to convey a plurality of sheets of paper successively, it is necessary to return the paper ejection rollers which have ejected the page of the (2n)th copy from the sorting position before the leading end of the next sheet of paper arrives at these paper ejection rollers. The plurality of sheets of paper are conveyed successively with a predetermined conveyance gap being provided between the rear end of the first sheet and the leading end of the next sheet. Due to this, the sorting mechanism must return the paper ejection rollers from their sorting position to their initial position during this predetermined conveyance gap.

With image forming apparatus, in recent years, the speed of image formation has been progressively increased. For example there are some such devices which, when conveying a sheet of A4 paper along the direction parallel to its short side, can perform image formation at a paper speed of 600 mm/sec, thus making 100 to 120 copies per minute. With such an image forming apparatus, the paper conveyance gap is about 90 mm, so that, in order to discharge paper one sheet at a time using a sorting mechanism, it is necessary to return the paper ejection rollers from their sorting position to their initial position during a period of 90 mm÷600 mm/sec=0.15 second.

Due to this, with a prior art image forming apparatus which discharges paper one sheet at a time using a sorting mechanism, there has been the problem of a shortage of time for returning the paper ejection rollers from their sorting position to their initial position, so that difficulty has arisen in discharging the pages of a plurality of copies of a document while sorting these pages accurately into different positions for each of the copies. This problem does not only occur with an image forming apparatus; it is a problem which occurs in general with paper processing devices which perform processing at high speed.

A feature of the present invention is to provide an image forming apparatus and, a paper processing method, with which, when paper ejection rollers for performing sorting processing of paper sheets are being shifted to and fro between an initial position and a sorting position, discharges a predetermined number of sheets of paper from the paper ejection rollers in a state in which they are mutually superimposed, so that the time period which can be used for the return movement of the paper ejection rollers is extended, and which can discharge the pages of a plurality of copies of a document while sorting them into the individual copies at high accuracy.

SUMMARY OF THE INVENTION

The paper processing device according to the present invention includes a processing unit, paper ejection rollers, a sorting mechanism, a paper overlapping mechanism, and a control unit. The processing unit performs predetermined processing, such as image formation processing or the like, upon sheets of paper which are being conveyed one at a time along a paper conveyance direction. The paper ejection roller discharges the sheets of paper, after completion of processing by the processing unit, in the paper conveyance direction. The sorting mechanism shifts the paper ejection roller to and fro along a rotation shaft between an initial position and a sorting position in a direction which is orthogonal to the paper conveyance direction. The paper overlapping mechanism superimposes, between the processing unit and the paper ejection roller in the paper conveyance direction, a predetermined number of sheets of paper upon which processing has been completed. And the control unit superimposes a predetermined number of sheets of paper by operating the paper overlapping mechanism, before shifting the paper ejection roller from the initial position to the sorting position with the sorting mechanism.

And the paper processing method according to the present invention includes a processing process and a discharge process. In the processing process, predetermined processing, such as image formation processing or the like, is performed upon sheets of paper which are being conveyed one at a time along a paper conveyance direction. And, in the discharge process, a paper ejection roller is shifted to and fro between an initial position and a sorting position in a direction which is orthogonal to the paper conveyance direction, thus discharging a plurality of sheets of paper after completion of processing, sorted into groups, in different positions in the direction which is orthogonal to the paper conveyance direction. Moreover, during the discharge process, a predetermined number of sheets of paper are superimposed before shifting the paper ejection roller from the initial position to the sorting position.

When shifting the paper ejection roller to and fro between its initial position and its sorting position in order to perform sorting processing of the sheets of paper, the predetermined number of sheets of paper are discharged from the paper ejection roller in the state in which they are mutually superimposed. Accordingly, as compared to the case in which the sheets of paper are discharged one at a time, the time period which it is possible to use for returning the paper ejection roller becomes longer.

In this image forming apparatus of the present invention, it would also be possible to further include a re-transportation path and a switch back transportation path, along which, during double sided image formation in which images are formed on both sides of the paper, paper sheets upon which images have been formed on one side pass. And, in this case, the paper overlapping mechanism stores two sheets of paper which are to be mutually superimposed between the image formation device and the paper ejection roller in the paper conveyance direction, one in the re-transportation path, and one in the switch back transportation path.

When shifting the paper ejection roller for performing sorting processing of the sheets of paper to and fro between its initial position and its sorting position, after having retained two sheets of paper upon which image formation has been completed in the re-transportation path and in the switch back transportation path respectively, they are discharged from the paper ejection roller as mutually superimposed. Accordingly it is possible to make longer the time period which can be used for returning the paper ejection roller, by employing the re-transportation path and switch back transportation path, which already are present in an image forming apparatus which is endowed with a double sided image formation function.

In this image forming apparatus of the present invention, it would also be possible to form an image upon the upper surface of a sheet of paper which is being conveyed in the paper conveyance direction with the image formation device, and to further include a confluence transportation path which inverts the upper and lower surfaces of, and discharges, paper sheets which have been stored in the re-transportation path and the switch back transportation path, at a confluence position between the image formation device and the paper ejection roller in the paper conveyance direction. The paper overlapping mechanism, after having transported the earlier sheet of paper, and the later sheet of paper, among two sheets of paper which are being successively conveyed, respectively in order to the lower transportation path and to the higher transportation path among the re-transportation path and the switch back transportation path, discharges them from the confluence transportation path at the confluence position while inverting their upper and lower surfaces.

When shifting the paper ejection roller for performing sorting processing of the sheets of paper, upon whose upper surfaces images have been formed, to and fro between its initial position and its sorting position, among the two sheets of paper which are being successively conveyed, the earlier sheet of paper is transported to the lower transportation path, while the later sheet of paper is transported to the higher transportation path. And these sheets of paper are mutually superimposed while their upper and lower surfaces are inverted by the confluence transportation path. Accordingly, the plurality of sheets of paper are discharged in sequence with their images in order, in the state in which their image surfaces are facing downwards.

BRIEF DESCRIPTION OF THE DRAWINGS

FIG. 7 is a flow chart showing the flow of a procedure for paper conveyance processing performed by a control unit, during single sided image formation by this image forming apparatus;

FIG. 8 is a flow chart showing the flow of a procedure for sorting processing performed by the control unit, during single sided image formation by this image forming apparatus;

DETAILED DESCRIPTION OF THE INVENTION

In the following an image forming apparatus which is a preferred embodiment of the paper processing device of the present invention will be explained in detail with reference to the appended drawings.

Figure 1:
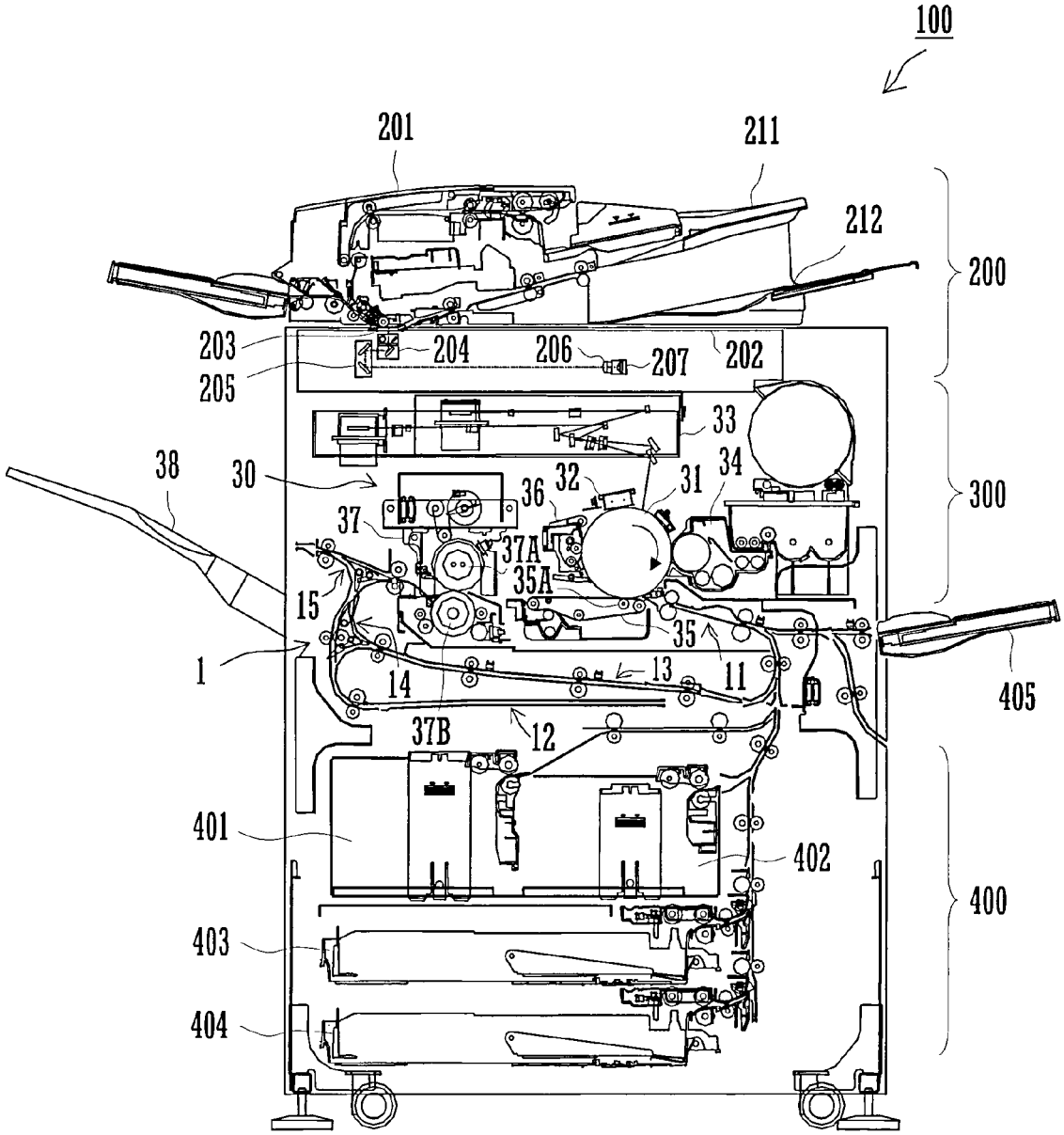
FIG. 1 is a schematic elevation cross sectional figure showing the structure of an image forming apparatus according to an embodiment of the present invention.

FIG. 1 is an schematic elevation cross sectional figure showing the structure of an image forming apparatus according to an embodiment of the present invention. The image forming apparatus 100 of this invention comprises an image reading unit 200, an image formation unit 300, and a paper supply unit 400.

The image reading unit 200 comprises an automatic manuscript feeder (ADF) 201, a first manuscript support 202, a second manuscript support 203, a first mirror base 24, a second mirror base 205, a lens 206, and a solid-state image sensing device 207 (i.e., a CCD).

The ADF 201 conveys a manuscript from a manuscript tray 211 to a discharge tray 212 one sheet at a time via the second manuscript support 203. And the rear end of the surface of the ADF 201 is supported upon a fulcrum in a freely rotatable manner, so as to be freely opened and closed and so as to cover over the upper surface of the first manuscript support 202. By shifting the leading end of the ADF upwards, thus rotating the ADF 201 upwards and rearwards so as to expose the upper surface of the first manuscript support 202, it is possible to load a manuscript upon the first manuscript support 202 by manual operation.

The first manuscript support 202 and the second manuscript support 203 are both made as hard glass plates.

The first mirror base 204 and the second mirror base 205 are freely shiftable in the horizontal direction under the first manuscript 202 and the second manuscript support 203. The shifting speed of the second mirror base 205 is one half of that of the first mirror base 204. A light source and a first mirror are mounted upon the first mirror base 204. And a second mirror and a third mirror are mounted upon the second mirror base 205.

When the image of a manuscript conveyed by the ADF 201 is to be read, the first mirror base 204 stops below the second manuscript support 203. The light from the light source irradiates upon the image surface of the manuscript by passing through the second manuscript support 203, and the light which is reflected by the image surface of the manuscript is reflected by the first mirror towards the second mirror base 205.

When the image of a manuscript which is loaded upon the first manuscript support 202 is to be read, the first mirror base 204 and the second mirror base 205 are shifted in the horizontal direction under the first manuscript support 202. And the light from the light source irradiates upon the image surface of the manuscript which is loaded upon the first manuscript support 202, and the light which is reflected by the image surface of the manuscript is reflected by the first mirror towards the second mirror base 205.

Irrespective of whether or not the ADF 201 is employed, the length of the optical path of the light which is reflected by the image surface of the manuscript is kept constant, and this light is reflected by the second mirror and the third mirror, and is incident upon the CCD 207 via the lens 206.

The CCD 207 outputs an electrical signal which corresponds to the amount of light reflected by the image surface of the manuscript. This electrical signal is inputted to the image formation unit 300 as image data.

The image formation unit 300 comprises a photosensitive drum 31 which constitutes an image forming apparatus 30, an electrification device 32, an exposure device 33, a development device 34, a transfer belt 35, a cleaner 36, and a fixer device 37.

A photosensitive layer is formed upon the surface of the photoreceptive drum 31, which rotates in the direction of the arrow sign. The electrification device 32 electrifies the surface of the photoreceptive drum 31 uniformly to a predetermined electrical potential. In this electrification device 32, there may be employed either a non-contact method using a charger, or a contact method using a roller or a brush.

The exposure device 33 irradiates light upon the surface of the photoreceptive drum 31 based upon the image data. By doing this, a latent electrostatic image is created upon the surface of the photoreceptive drum 31 due to photoconductive action in its photosensitive layer. The exposure device 33 irradiates laser light which has been modulated based upon the image data from a semiconductor laser. This laser light is deflected in the axial direction of the photoreceptive drum 31 by a polygonal mirror, so as to scan the surface of the photoreceptive drum 31 along its axial direction. Instead of this, it would also be acceptable to employ an exposure device in which a plurality of light emitting elements, such as ELs or LEDs or the like, are disposed in the form of an array.

The development device 34 supplies toner to the surface of the photoreceptive drum 31, and converts the latent electrostatic image into a visible toner image.

The transfer belt 35 is extended in a loop shape between a plurality of rollers below the photoreceptive drum 31, and has a resistance value of around $1\times10^{9}$ O·cm. to $1\times10^{13}$ O·cm. On the inside of the loop shaped path of the transfer belt 35, there is provided a transcription roller 35A which presses against the photoreceptive drum 31 with the transfer belt 35 being interposed between them. A predetermined transcription voltage is applied to this transcription roller 35A, and thereby the toner image carried upon the photoreceptive drum 31 is transcribed onto a sheet of paper which passes between the transfer belt 35 and the photoreceptive drum 31.

After the toner image has thus been transcribed to the paper, the cleaner 36 eliminates any remaining toner upon the surface of the photoreceptive drum 31.

The fixing device 37 comprises a heating roller 37A and a pressurization roller 37B. The heat application roller 37A raises the toner to its melting temperature with an internal heater. The pressure roller 37B applies a predetermined pressure to the heat application roller 37A. The fixing device 37 fixes the toner image durably upon the paper by applying heat and pressure to the paper as it passes between the heating roller 37A and the pressure roller 37B. And the paper which has thus passed through the fixing device 37 is discharged into a paper ejection tray 38 which is fitted to one side of this image forming apparatus 100.

The paper supply unit 400 comprises paper supply cassettes 401, 402, 403, and 404 and a manual paper insertion tray 405, with a plurality of sheets of paper of the same size being stored in each of these paper supply cassettes 401, 402, 403, and 404. Paper sheets of a size or a quality which is not often used are loaded via the manual paper insertion tray 405.

This paper supply unit 400 performs supply of paper, one sheet at a time, from any one of the paper supply cassettes 401, 402, 403, and 404, or from the manual paper insertion tray 405. The paper which is thus supplied from the paper supply unit 400 is conveyed to the image forming apparatus 30 via a paper transportation path 1 which will be described hereinafter.

Figure 2:
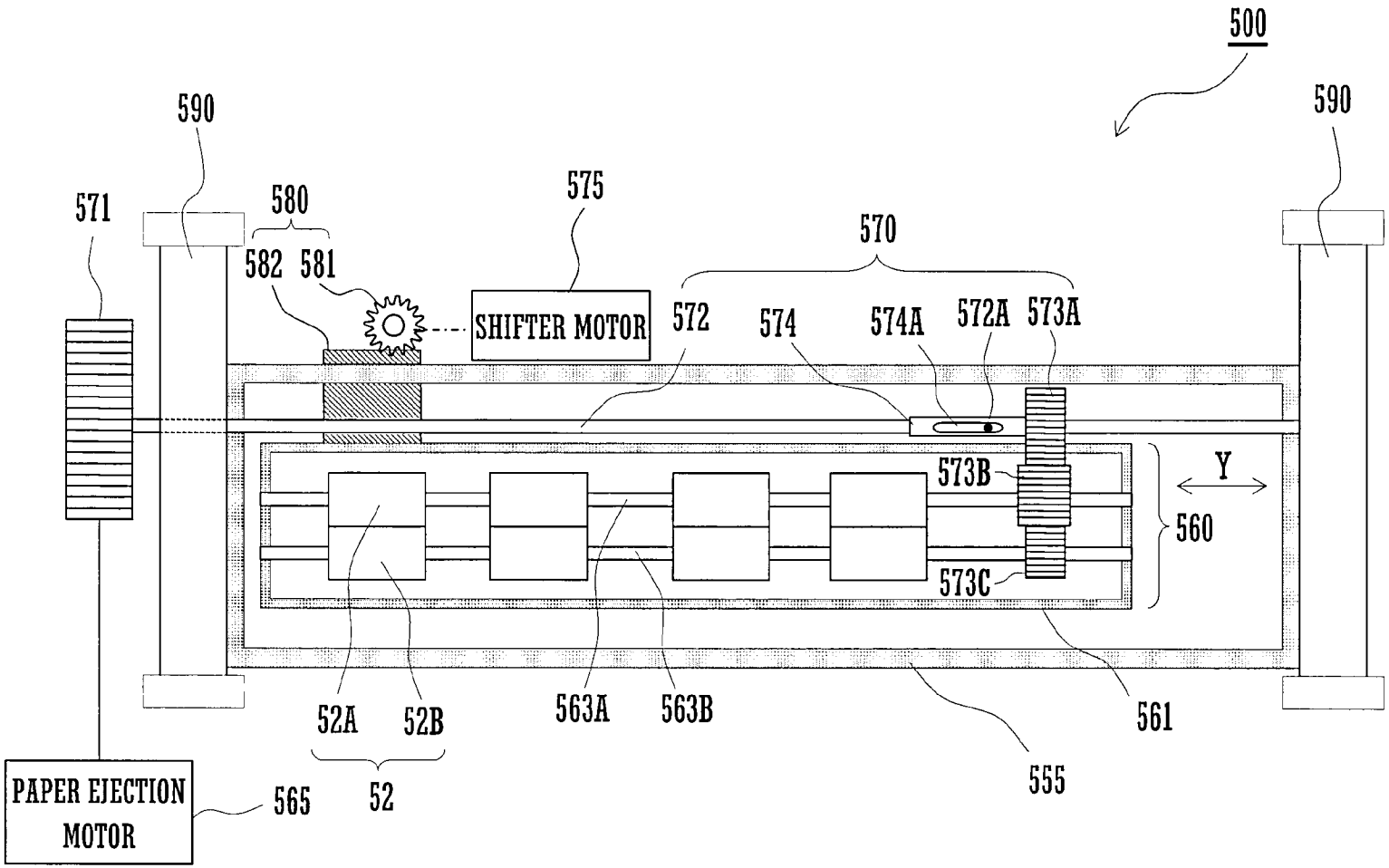
FIG. 2 is a side sectional view showing the structure of a shifter mechanism incorporated in this image forming apparatus, in a state in which an offsetting member thereof is positioned to an initial position.
Figure 3:
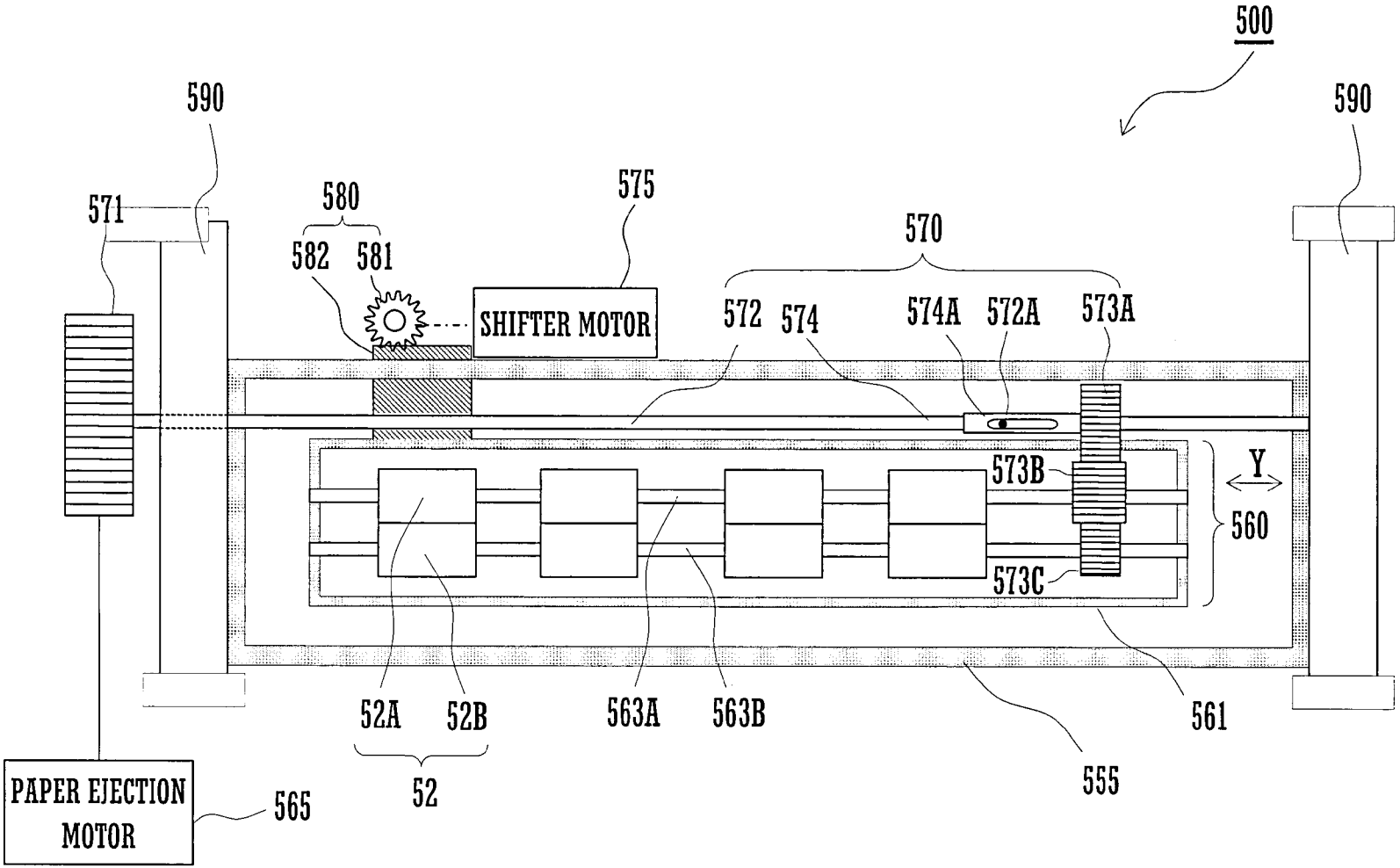
FIG. 3 is a side sectional view showing the structure of this shifter mechanism incorporated in this image forming apparatus, in a state in which the offsetting member thereof is positioned to a sorting position.

FIGS. 2 and 3 are side sectional views showing the structure of a shifter mechanism 500 which is incorporated in this image forming apparatus 100. These FIGS. 2 and 3 are figures showing the shifter mechanism 500 as seen from the downstream side of the paper conveyance direction. The shifter mechanism 500, which corresponds to the "sorting mechanism" of the Claims, comprises a chassis 555, an offsetting unit 560, a paper ejection motor 565, a drive transmission unit 570, a shifter motor 575, a drive transmission unit for offsetting 580, and the like; and it discharges paper sheets upon which image formation has been completed into the paper ejection tray 38.

The chassis 555 is supported upon a frame 590 of the device main body, and it holds the offsetting unit 560 and the drive transmission unit 570 in its interior, and the shifter motor 575 and the drive transmission unit for offsetting 580 at its exterior. The offsetting unit 560 comprises a chassis 561 and paper ejection rollers 52 and so on, and, for example, shifts along the Y axis from a state like that shown in FIG. 2 to a state like that shown in FIG. 3, thus discharging a sheet of paper as offset. The chassis 561 supports the paper ejection rollers 52 so that they can rotate freely to discharge the paper in the paper conveyance direction. These paper ejection rollers 52 comprise a plurality of pairs of upper rollers 52A and lower rollers 52B, and they pass the paper between the upper rollers 52A and the lower rollers 52B while they rotate, thus discharging it into the paper ejection tray 38.

The paper ejection motor 565 generates rotatory power for supply to the paper ejection rollers 52. The drive transmission unit 570 comprises a shaft 572, link gears 573A through 573C, a slider member 574, and the like, and it supplies to the paper ejection rollers 52 the drive force from the paper ejection motor 565 which is transmitted to the drive gear 571. This drive gear 571 is connected to the paper ejection motor 565, and is coaxially fixed to the shaft 572, which it rotates.

The shaft 572 is freely rotatably supported by the chassis 555 around an axis parallel to the Y axis, and supports a slider member 574, which is fitted over it so as to be able to slide freely. Furthermore, the shaft 572 supports the offsetting unit 560, via the slider member 574 and the link gear 573, so that it is freely shiftable in a direction which is orthogonal to the conveyance direction of the paper.

In the slider member 574 there is formed a slot 574A, with its longitudinal axis extending parallel to the Y axis direction. A guide member 572A projects from the shaft 572. This guide member 572A is fitted into the slot 574A, and can only shift freely within the slot 574A. By this guide member 572A fitting into the slot 574A, the shift range of the link gears 573A through 573C and the offsetting unit 560 in the direction parallel to the Y axis is regulated.

The link gear 573A is fixed coaxially with the slider member 574, and is supported so as to slide freely on the shaft 572 along the Y axis along with the slider member 574. By the guide member 572A fitting into the slot 574A, the rotation of the shaft 572 is transmitted to the slider member 574. Due to this, the link gear 573A rotates as one together with the slider member 574 and the shaft 572. One portion of the link gear 573A fits into a hole portion which is provided on the shaft side of the chassis 561, and is exposed within the chassis 561 so as to be meshed with the link gear 573B.

The link gear 573B and the link gear 573C are provided within the chassis 561. The link gear 573C is meshed with the link gear 573B. Accordingly, the rotation of the link gear 573A is transmitted to the link gear 573B and thence to the link gear 573C. The link gear 573B is coaxially fixed upon one end of the support shaft 563A which supports the rollers 52A. And the link gear 573C is coaxially fixed upon one end of the support shaft 563B which supports the roller 52B.

When the link gear 573B and the link gear 573C rotate, the rollers 52A and the rollers 52B rotate along with the support shaft 563A and the support shaft 563B. Since the link gear 573B and the link gear 573C rotate in mutually opposite directions, accordingly the rollers 52A and the rollers 52B rotate in mutually opposite directions. Due to this, the circumferential surfaces of the rollers 52A and the circumferential surfaces of the rollers 52B shift in the same direction, thus constituting a contact portion (a nipping region).

The shifter motor 575 is connected to the drive transmission unit for offsetting 580, and generates a shifting force for supply to the offsetting unit 560, along the direction of the arrow sign Y. The drive transmission unit for offsetting 580 comprises a pinion gear 581 and a rack gear 582. The pinion gear 581 supplies rotatory power from the shifter motor 575, and is meshed with the rack gear 582. The rack gear 582 is fixed to the chassis 561.

Thus, the rotation of the shifter motor 575 is converted into force in the direction parallel to the Y axis due to the meshing of the pinion gear 581 and the rack gear 582, and shifts the chassis 561 along the Y axis. At this time, the inner surface of the hole portion of the chassis 561 contacts against the side surface of the link gear 573A, so that the link gear 573A and the slider member 574 shift along the Y axis together with the chassis 561.

The shifter mechanism 500 shifts the offsetting unit 560 between its initial position shown in FIG. 2 and its sorting position shown in FIG. 3, when a setting for execution of the sort function for paper sheets has been inputted by pressing various input keys which are provided upon an actuation panel section. By shifting the discharge position of paper sheets upon the paper ejection tray 38 in a direction which is orthogonal to the paper conveyance direction, this shifter mechanism 500 performs offset discharge of the paper sheets in a sorting position which is displaced by just a predetermined amount along the front surface edge of the image forming apparatus 100 with respect to its initial position, taken as a reference.

This sorting function, for example, may be performed upon a plurality of sheets of paper upon which formation of the same image has been performed, and is used during multiple copy image formation in which a plurality of copies of a document are to be created. In this case, the shifter mechanism 500 discharges the sheets for the odd numbered copies (i.e. the pages of the (2n−1)th copy, where n=1, 2, 3, . . . ) into the paper ejection tray 38 while positioning the offsetting unit 560 to its initial position, and discharges the sheets for the even numbered copies (i.e. the pages of the (2n)th copy) into the paper ejection tray 38 while positioning the offsetting unit 560 to its sorting position.

By the paper transportation path 1 within the image forming apparatus 100, the paper sheets are conveyed to a position which corresponds to the initial position of the offsetting unit 560, with respect to the direction which is orthogonal to the paper conveyance direction.

When discharging a page of an odd numbered copy, after the leading end of this page of the odd numbered copy has arrived at the paper ejection rollers 52, the offsetting unit 560 is kept stopped in its initial position, until the rear end of this page of the odd numbered copy passes the paper ejection rollers 52.

When discharging a page of an even numbered copy, the offsetting unit 560 is positioned at its initial position until the leading end of this page of the even numbered copy is sandwiched between and is gripped by the paper ejection rollers 52, and then is shifted along from its initial position towards its sorting position while the paper ejection rollers 52 are in the state in which they are sandwiching and gripping this even numbered sheet. The offsetting unit 560 starts shifting back from its sorting position to its initial position after the rear end of this page of the even numbered copy has passed the paper ejection rollers 52, and it must return to its initial position before the leading end of the next sheet of paper arrives at the paper ejection rollers 52.

It should be understood that the drive transmission unit 570 is not necessarily limited to being of a type which includes the link gears 573A through 573C. The drive transmission unit 570 may be of any suitable structure which, along with being capable of shifting the offsetting unit 560 along the Y axis, does not reduce the portion of the rotatory power of the paper ejection motor 565 which is transmitted at this time to the paper ejection rollers 52. For example, it would be possible for this drive transmission unit 570 to be constituted by a shaft 572 which has a projecting portion, and an endless belt which is extended between the shaft 572 and the support shaft 563A. In this case, the rotatory power would be transmitted to the paper ejection rollers by the belt, and, by the projecting portion of the shaft 572 contacting against a portion of the chassis 561, the belt and the shaft 572 would be shifted along the Y axis together with the offsetting unit 560.

Figure 4:
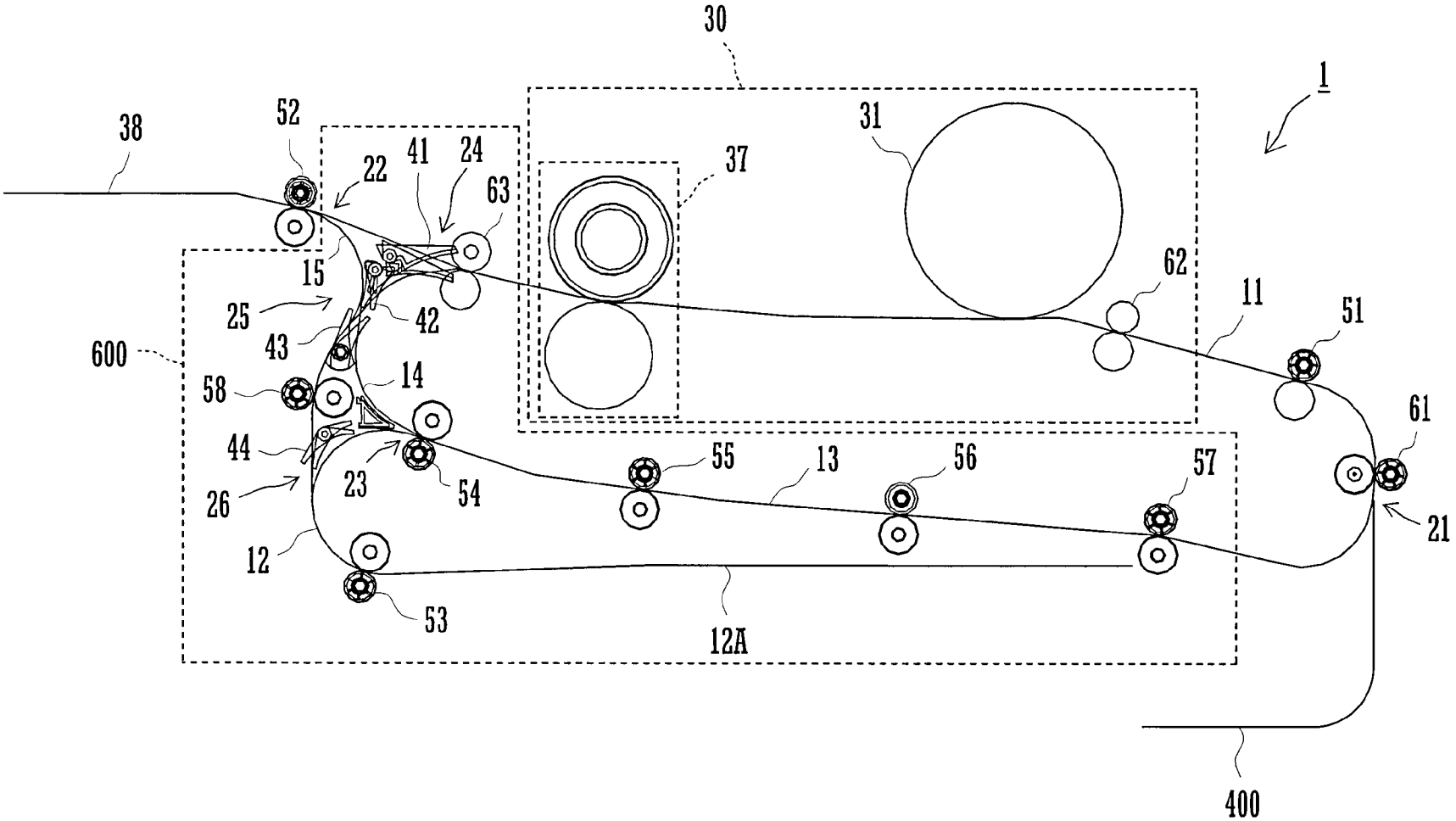
FIG. 4 is a figure showing the structure of a paper transportation path in this image forming apparatus.

FIG. 4 is a figure showing the structure of the paper transportation path 1 in this image forming apparatus 100. The paper transportation path 1 is constituted in the interior of the image formation unit 300. This paper transportation path 1 includes a first transportation path 11, a second transportation path 12, a third transportation path 13, a fourth transportation path 14, and a fifth transportation path 15.

The first transportation path 11 starts from the paper supply unit 400, and passes through, in order, a first confluence unit 21, the image forming apparatus 30, a first branch off unit 24, and a second confluence unit 22, finally arriving at the paper ejection tray 38. On this first transportation path 11 there are provided feeding out rollers and paper supply rollers not shown in the drawing, conveyance rollers 61, 62, and 63, a transfer belt 64, a registration roller 51, the paper ejection rollers 52, and so on. Rotation is supplied to the feeding out rollers, the paper supply rollers, the conveyance rollers 61 through 63, the transfer belt 64, the registration roller 51, and the paper ejection rollers 52 from a plurality of motors, not shown in the drawing.

In the portion of this first transportation path 11 which passes through the image forming apparatus 30, a transfer belt not shown in the drawing is arranged approximately horizontally, in order to transcribe a toner image from the photoreceptive drum 31 to the surface of the paper in a stable manner, and in order to convey the paper in a stable manner while it is electrostatically adsorbing the toner image before fixing.

The second transportation path 12 starts from the first branch off unit 24 which is arranged in the first transportation path 11 between the image forming apparatus 30 and the paper ejection tray 38, and passes through a lower second branch off unit 25 and third branch off unit 26 in that order, to arrive at a switch back transportation path 12A. This switch back transportation path 12A is arranged approximately parallel to the range of the first transportation path 11 through the image forming apparatus 30, and conveys paper sheets in the return direction. A switch back roller 53 and a conveyance roller 58 are provided in this second transportation path 12. Rotational power is supplied to these rollers 53 and 58 from a first motor and a second motor, not shown in the figures, selectively either in the forward rotational direction or in the reverse rotational direction.

The third transportation path 13 corresponds to the "re-transportation path" of the Claims, and starts from the third branch off unit 26, passes through the third confluence unit 23, to arrive at the first confluence unit 21 which is provide in the first transportation path 11 between the paper supply unit 400 and the image forming apparatus 30. Conveyance rollers 54 through 57 are provided in this third transportation path 13. Rotational power is supplied to the conveyance roller 54 from a third motor not shown in the drawing, selectively either in the forward rotational direction or in the reverse rotational direction. And rotational power is supplied to the conveyance rollers 55 through 57 from another motor not shown in the drawing, selectively either in the forward rotational direction or in the reverse rotational direction.

The fourth transportation path 14 connects between the second branch off unit 25 and the third confluence unit 23. And the fifth transportation path 15 corresponds to the "confluence transportation path" of the Claims, and connects from the second branch off unit 25 to the second confluence unit 22.

The switch back transportation path 12A is disposed so as to be mutually approximately parallel to, and below, the range of the first transportation path 11 where it passes through the image forming apparatus 30 which is arranged in the approximately horizontal direction. And the third transportation path 13 is disposed between the range of the first transportation path 11 where it passes through the image forming apparatus 30, and the switch back transportation path 12A.

Figure 5:
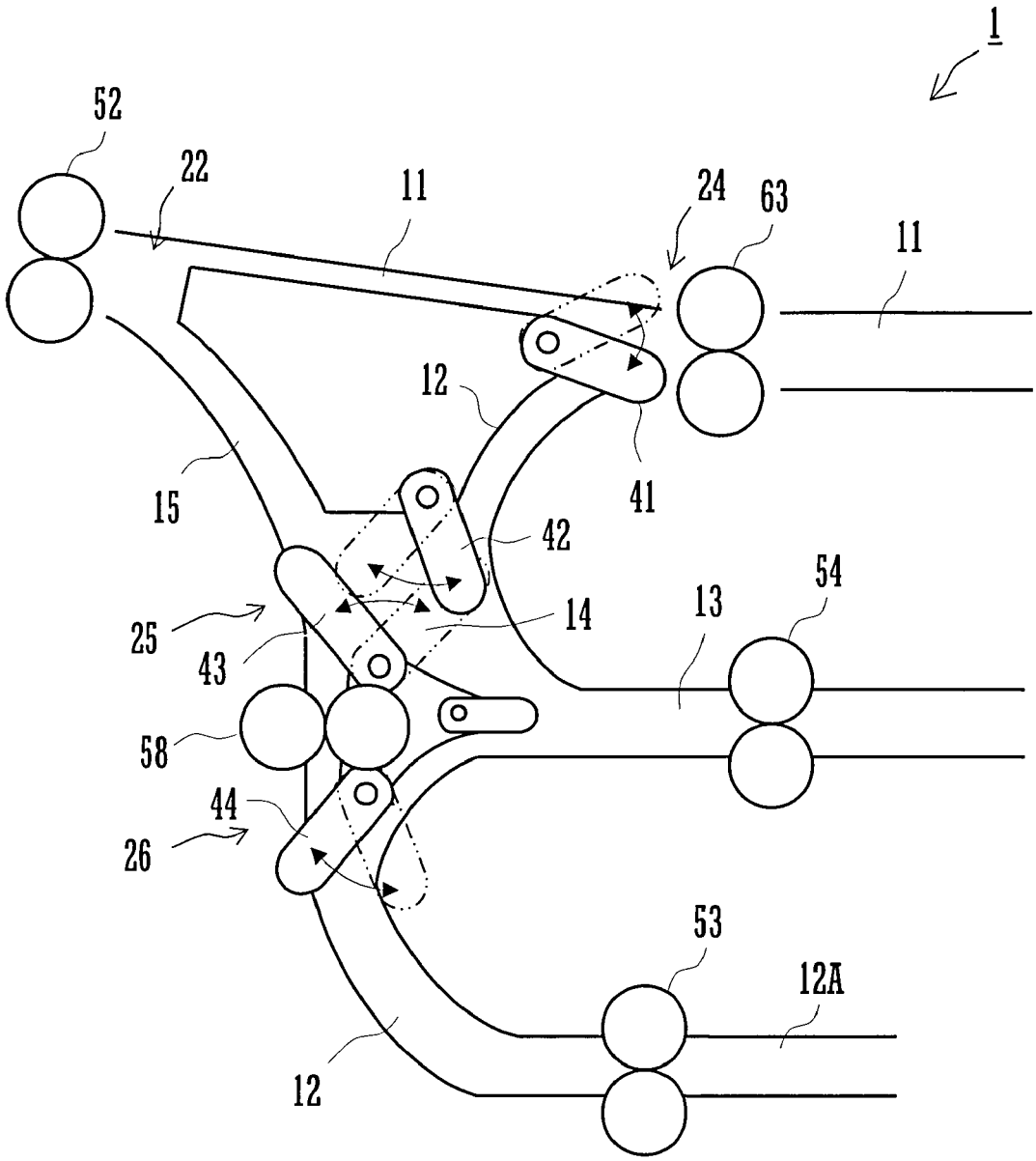
FIG. 5 is a figure showing the structure of a first branch off unit, a second branch off unit, and a third branch off unit in the paper transportation path of this image forming apparatus.

FIG. 5 is a figure showing the structure of the first branch off unit 24, the second branch off unit 25, and the third branch off unit 26 in the paper transportation path 1 of the image forming apparatus 100 described above. A branch off claw 41 is provided in this first branch off unit 24. By this branch off claw 41 being operated by a first solenoid not shown in the drawing, it is pivoted between the position shown by solid lines in FIG. 5 and the position shown by broken lines, so that the conveyance direction of a paper sheet may be switched over by the first branch off unit 24 to either the first transportation path 11 or the second transportation path 12.

A branch off claw 42 and a branch off claw 43 are provided to the second branch off unit 25. In its state in which no external force operates upon it, the branch off claw 42 is positioned to its position shown by the solid lines in FIG. 5, and accordingly guides a paper sheet which has been conveyed upwards from the second transportation path 12 or the fourth transportation path 14 into the fifth transportation path 15. And a paper sheet which has been conveyed upwards from the second transportation path 12 or the third transportation path 13 is regulated so as to be forwarded into the second transportation path 12 by this branch off claw 42.

By the branch off claw 43 being operated by a second solenoid not shown in the drawing, it is pivoted between the position shown by solid lines in FIG. 5 and the position shown by double dotted broken lines, so that either between the fourth transportation path 14 and the fifth transportation path 15, or between the second transportation path 12 and the fifth transportation path 15, is opened by the second branch off unit 25.

It should be understood that the branch off claw 42 is pivoted to the position shown in FIG. 5 by the double dotted broken lines by being contacted against a sheet of paper which has been conveyed downwards from the first branch off unit 24 within the second transportation path 12.

A branch off claw 44 is provided to the third branch off unit 26. During double sided image formation, a sheet of paper whose front and rear ends have been inverted within the switch back transportation path 12A is conveyed from the second transportation path 12 to the third transportation path 13. Furthermore, during sorting processing, a sheet of paper whose front and rear ends have been inverted in the switch back transportation path 12A is conveyed from the second transportation path 12 via the fifth transportation path 15 to the upstream side of the paper ejection rollers 52. Due to this, the conveyance rollers 58 rotate both forwards and backwards. Moreover, by being operated by a third solenoid not shown in the figures, the branch off claw 44 selectively opens between the second transportation path 12, and either the third transportation path 13 or the fifth transportation path 15.

Figure 6:
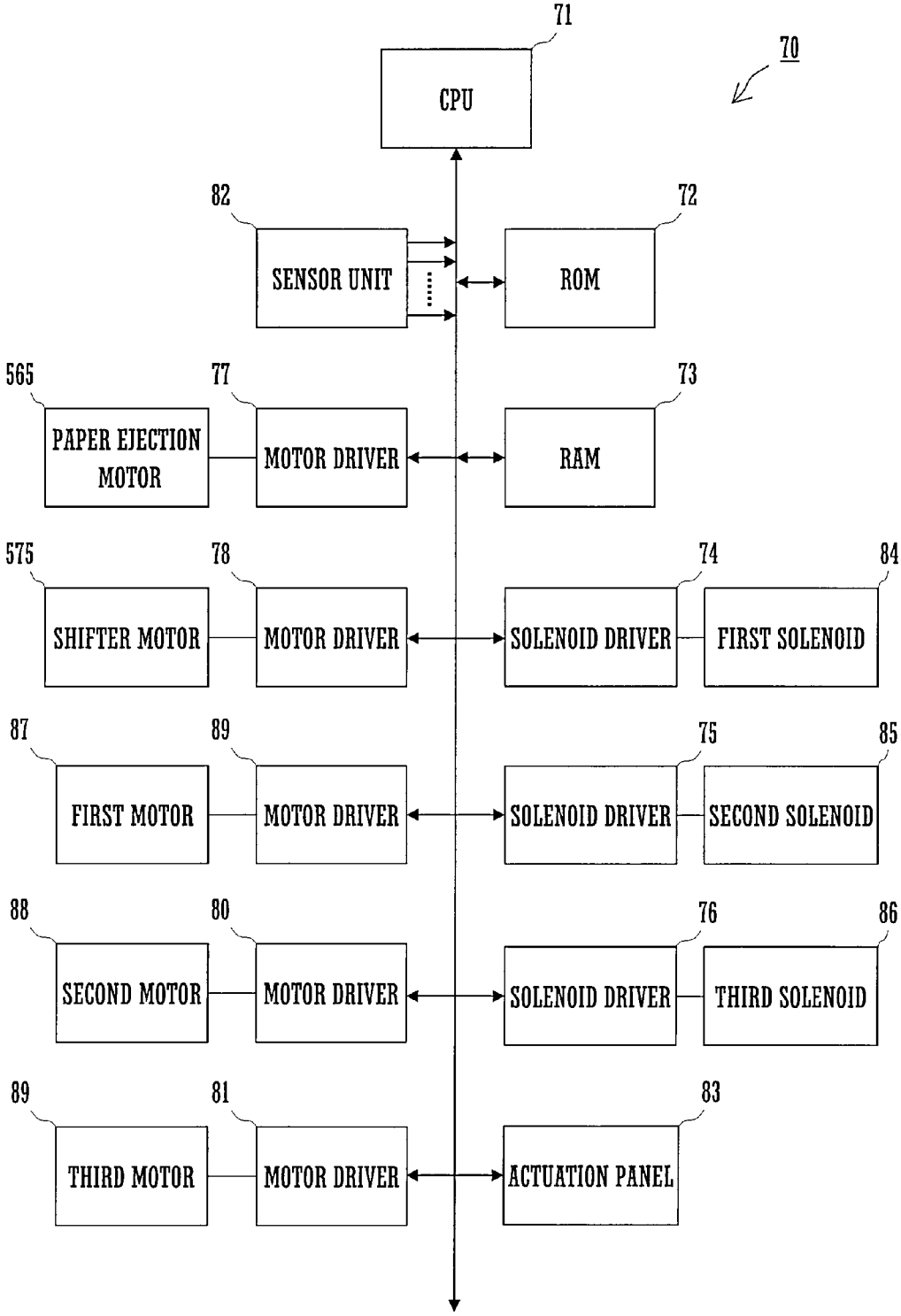
FIG. 6 is a block diagram showing the structure of a control unit of this image forming apparatus.

FIG. 6 is a block diagram showing the structure of the control unit 70 of the image forming apparatus 100 described above. This control unit 70 of the image forming apparatus 100 comprises solenoid drivers 74 through 76, motor drivers 77 through 81, a sensor unit 82, an actuation panel 83, all connected to a CPU 71 which comprises a ROM 72 and a RAM 73, along with an exposure device 33 of the image forming apparatus 30 and so on.

A plurality of sensors which are disposed within the paper transportation path 1 are included in the sensor unit 82. Each of this plurality of sensors detects the presence of a sheet of paper at a mutually different position within the paper transportation path, and inputs its detection signal to the CPU 71. The CPU 71 detects the state of conveyance of the sheet of paper, based upon the detection signals which are inputted from the sensor unit 82.

The CPU 71 refers to the detection signals which have been inputted from the sensor unit 82, according to a program which is read into the ROM 72 in advance, and outputs drive data to the devices such as the solenoid drivers 74 through 76, the motor drivers 77 through 81, the exposure device 33 and so on.

A first solenoid 84, a second solenoid 85, and a third solenoid 86 are connected to the solenoid drivers 74 through 76 respectively. The solenoid drivers 74 through 76 drive their respective solenoids based upon the drive data inputted from the CPU 71.

The paper ejection motor 565, the shifter motor 575, a first motor 87, a second motor 88, and a third motor 89 are connected to the motor drivers 77 through 81 respectively. And the motor drivers 77 through 81 drive their respective motors based upon the drive data inputted from the CPU 71.

The actuation panel 83 comprises key switches and a display not shown in the drawings. Along with inputting actuation signals from the key switches to the CPU 71, this actuation panel 83 displays messages and so on upon the display, based upon display data supplied from the CPU 71.

FIGS. 7 and 8 are flow charts showing the flow of a processing procedure performed by the control unit 70, during single sided image formation by this image forming apparatus 100. When an image formation request is inputted by actuation upon the actuation panel not shown in the drawings, the CPU 71, along with operating the image reading unit 200 and reading an image of a manuscript, also operates the various devices of the image forming apparatus 30, and starts image formation operation (steps S1, S2).

Figure 10:
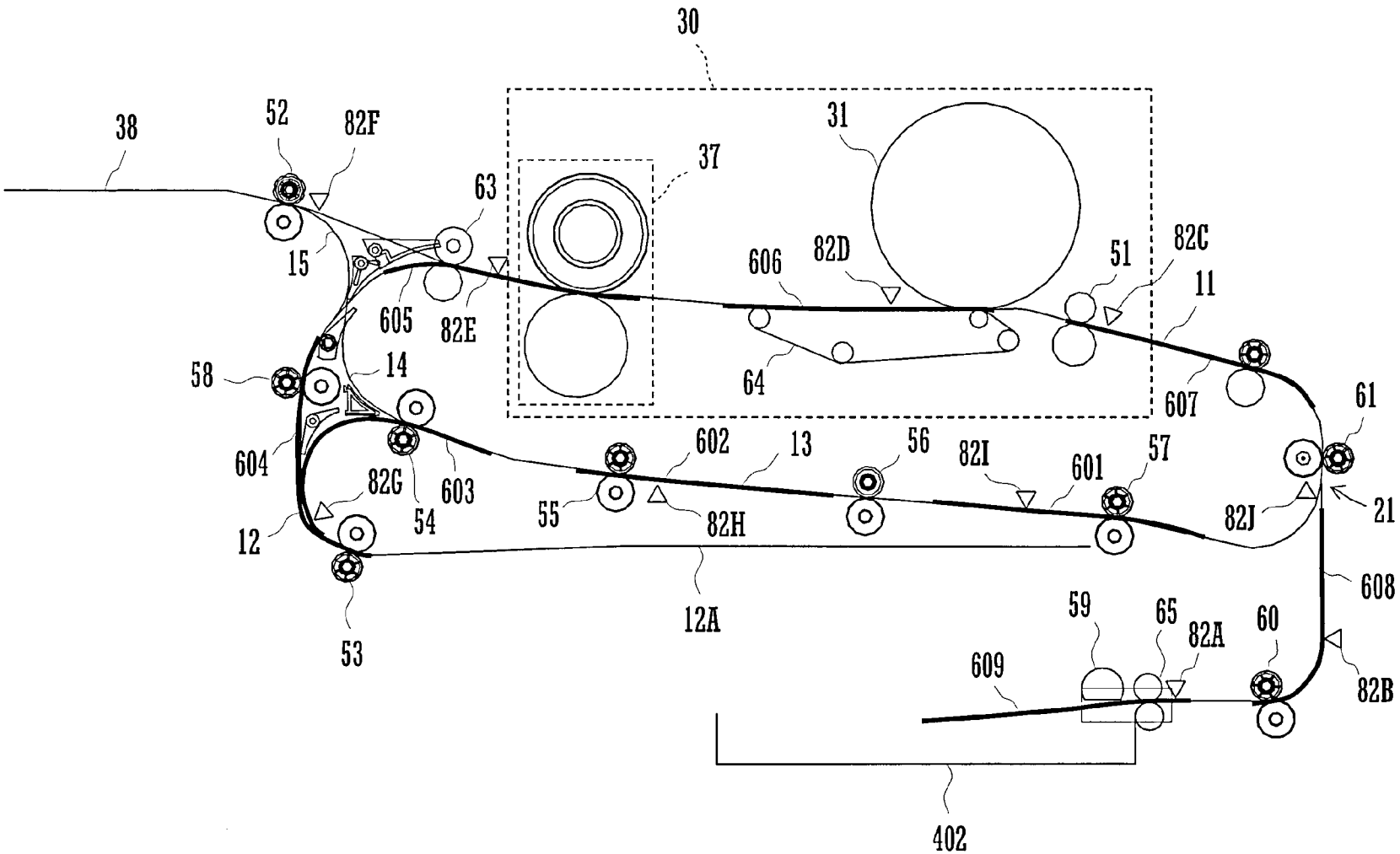
FIG. 10 is a figure showing a state of conveyance of paper during double sided image formation by this image forming apparatus, when an offsetting member of a shifter mechanism is not shifted.

Based upon the detection signal from a sensor 82F shown in FIG. 10, the CPU 71 decides whether or not the leading end of a sheet of paper has passed the fixing device 37 (step S3). If indeed the leading end of a sheet of paper has passed the fixing device 37, the CPU 71 decides whether or not the sort function is selected (step S4). If the sort function is selected, then the CPU 71 decides whether the sheet of paper which is passing through the fixing device 37 is a sheet of an odd numbered copy, or is a sheet of an even numbered copy (step S5).

If the sheet of paper which is passing through the fixing device 37 is a sheet of an even numbered copy, then the CPU 71 decides whether or not this sheet of paper is an odd numbered page or an even numbered page (step S6). If the sheet of paper which is passing through the fixing device 37 is an odd numbered page, then the CPU 71 drives the solenoids 84 through 86 and opens the direction of the second transportation path 12 with the branch off claws 41, 43, and 44 (step S7), and rotates the first motor 87 and the second motor 88 in the forwards direction (step S8). And, when a sensor 82G shown in FIG. 10 detects that the rear end of this sheet of paper has passed, the CPU 71 stops rotating the first motor 87 and the second motor 88 (steps S9 and S10).

By doing this, as shown in FIGS. 9(A) through (D), a sheet of paper 801 which is an odd numbered page of an even numbered copy is conducted from the first branch off unit 24 via the second transportation path 12 into the switch back transportation path 12A, and stops in the state in which its rear end is sandwiched by the switch back roller 53.

If the sheet of paper which is passing through the fixing device 37 is an even numbered page of an even numbered copy, then the CPU 71 drives the solenoids 84 through 86 and opens the direction of the third transportation path 13 with the branch off claws 41, 43, and 44 (step S11), and rotates the third motor 89 in the forward direction (step S12). And the CPU 71 stops rotating the third motor 89 before the rear end of this paper sheet passes the conveyance roller 54 (steps S13 and S14).

Figure 9:
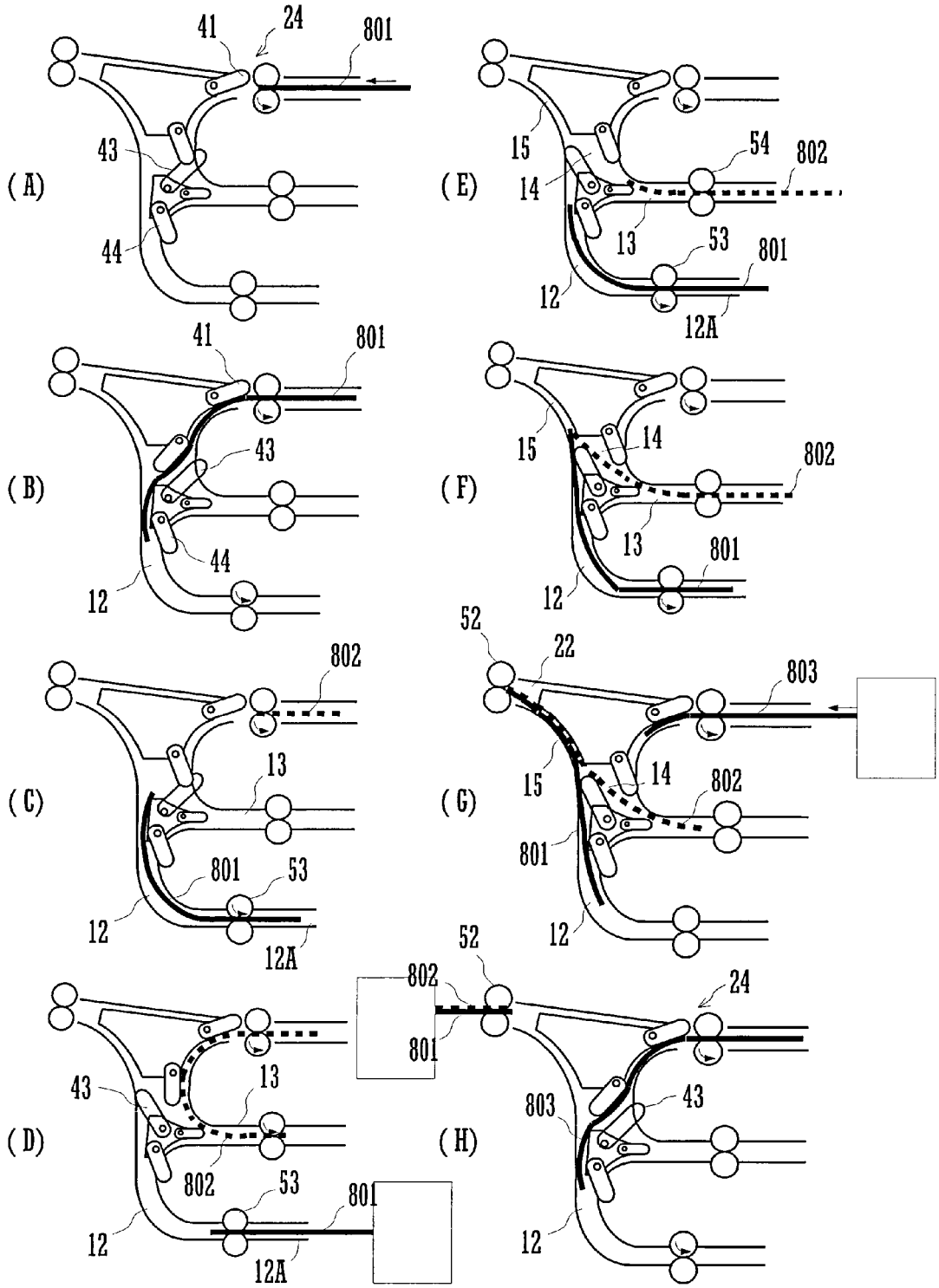
FIG. 9 is a set of figures showing stages in the conveyance of a sheet of paper during single sided image formation in which the sort function of this image forming apparatus is used.

By doing this, as shown in FIGS. 9(C) and (D), a sheet of paper 802 which is an even numbered page of an even numbered copy is conducted from the first branch off unit 24 into the third transportation path 13, and stops in the state in which its rear end is sandwiched by the conveyance roller 54.

After this, the CPU 71 opens the path between the third transportation path 13 and the fourth transportation path 14, and opens between the fourth transportation path 14 and the fifth transportation path 15 (step S15), and rotates the motors 87 through 89 in reverse at a predetermined timing (step S16). By doing this, along with the sheet of paper 801 which is an odd numbered page of an even numbered copy being conveyed within the second transportation path 12 and the fifth transportation path 15 towards the second confluence unit 22, the sheet of paper 802 which is an even numbered page of an even numbered copy is conveyed within the fourth transportation path 14 and the fifth transportation path 15 towards the second confluence unit 22.

The rotation in the reverse direction of the motors 87 through 89 in the step S16 is started at the timing at which the leading end of the sheet of paper 801 in the fifth paper transportation path 15 and the leading end of the sheet of paper 802 approximately agree with one another. Accordingly, as shown in FIGS. 9(E) through 9(G), the sheet 801 and the sheet 802 are fed from the second confluence unit 22 into the paper ejection rollers 52 in the state in which the sheet 801 is positioned underneath the sheet 802 and their leading ends are approximately in agreement with one another, and moreover with their image surfaces facing downwards.

If the sort function is not selected in the step S4, and if the sheet of paper which is passing through the fixing device 37 in the step S5 is a sheet of an even numbered copy, then the CPU 71 opens the direction of the third transportation path 13 (step S11), and drives the third motor 89 in the forwards direction (step S12). And the CPU 71 stops the rotation of the motor 89 before the rear end of this paper sheet passes the conveyance rollers 54 (steps S13 and S14).

After this, the CPU 71 opens between the third transportation path 13 and the fourth transportation path 14, and opens between the fourth transportation path 14 and the fifth transportation path 15 (step S15), and rotates the motor 89 in reverse at a predetermined timing (step S16).

By doing this, the sheet of paper is conveyed from the first branch off unit 24 into the third transportation path 13, and is stopped in the state with its rear end portion sandwiched by the conveyance roller 54. After this, this sheet of paper is conveyed within the fourth transportation path 14 and the fifth transportation path 15 towards the second confluence unit 22, with its image surface facing downwards.

After the processing of the steps S10 and S16, the CPU 71 makes a decision as to whether or not a subsequent sheet of paper is being conveyed towards the fixing device 37 (step S17). And the CPU 71 repeatedly executes the processing of the steps S3 through S22, until subsequent sheets of paper cease to be present.

If the next sheet of paper 803 after the sheet 802 which has been conveyed by the processing of the step S16 towards the second confluence unit 22 along with the sheet 801 is an odd numbered page of an even numbered copy, then the CPU 71 performs the processing in the steps S7 through S10. By doing this, as shown in FIGS. 9(G) and 9(H), this sheet of paper 803 is conducted from the first branch off unit 24 to the second transportation path 12 while the previous sheets of paper 801 and 802 are being conveyed via the fifth transportation path towards the second confluence unit 22 and are being discharged by the paper ejection rollers 52

On the other hand, during the image formation operation, based upon the detection signal from the sensor 82F, the CPU 71 waits for the leading end of a paper sheet to arrive at the paper ejection rollers 52 (step S31). When the leading end of a paper sheet arrives at the paper ejection rollers 52, then the CPU 71 makes a decision as to whether or not the sort function is currently selected (step S32). If the sort function is currently selected, then the CPU 71 makes a decision as to whether or not the sheet of paper which has arrived at the paper ejection rollers 52 is a page of an odd numbered copy or is a page of an even numbered copy (step S33).

If the paper sheet which has arrived at the paper ejection rollers 52 is a page of an even numbered copy, then the CPU 71 rotates the shifter motor 575 in the forward direction (step S34). Due to this, the offsetting unit 560 shifts from its initial position towards its sorting position in the state in which the paper ejection rollers 52 are sandwiching together two pages of an even numbered copy.

When the offsetting unit 560 arrives at its sorting position, then the CPU 71 stops the shifter motor 575 (steps S35 and S36). After this, and after the rear ends of the two pages of the even numbered copy have passed the paper ejection rollers 52, then the CPU 71 rotates the shifter motor 575 in the reverse direction (steps S37 and S38). Due to this, the offsetting unit 560 shifts from its sorting position towards its initial position. And, when the offsetting unit 560 arrives at its initial position, the CPU 71 stops the forward rotational operation of the shifter motor 575 (steps S39 and S40).

After the processing of the step S40, the CPU 71 makes a decision as to whether or not a subsequent sheet of paper is being conveyed towards the fixing device 37 (step S41). And the CPU 71 repeatedly executes the processing of the steps S31 through S40, until subsequent sheets of paper cease to be present.

The shifting of the offsetting unit 560 from its sorting position to its initial position must be completed during the time from when the rear end of the previous sheet of paper passes the paper ejection rollers 52 until when the leading end of the next sheet of paper reaches the paper ejection rollers 52. On the other hand, in order to increase the speed of the image formation process, the conveyance gap, which is the space between two sheets of paper which are being conveyed successively, is made shorter. Due to this, when image formation processing is performed at high speed, and when the sorting function with the shifter mechanism 500 is employed, the time for shifting the offsetting unit 560 from its sorting position to its initial position becomes short, and there is a possibility that it may become impossible reliably to return the offsetting unit 560 to its initial position by the time that the leading end of the next sheet of paper reaches the paper ejection rollers 52.

With this image forming apparatus 100, when shifting the offsetting unit 560 to and fro between its initial position and its sorting position, two sheets of paper are temporarily retained in the switch back transportation path 12A and the third transportation path 13, and the sheets of paper are conveyed to the paper ejection rollers 52 two at a time. In other words, after two superimposed sheets of paper have been discharged in the sorting position by the paper ejection rollers 52, the paper ejection rollers 52 are shifted from their sorting position to their initial position, before the next two superimposed sheets of paper arrive at the paper ejection rollers 52.

Due to this, it is possible to provide a sufficiently long time period as the time period for returning the offsetting unit 560, which was previously shifted to its sorting position, back to its initial position, and it is accordingly possible reliably to return the offsetting unit to its initial position before the leading ends of the next sheets of paper reach the paper ejection rollers 52.

Furthermore, to consider the switch back transportation path 12A and the third transportation path 13, the switch back transportation path 12A, which is in the lower position, retains the first sheet of paper, and the third transportation path 13, which is in the upper position, retains the next sheet of paper. When the two sheets of paper which have been retained in the switch back transportation path 12A and the third transportation path 13 are conveyed towards the paper ejection tray 38 while in the superimposed state, among these two sheets of paper upon which page images have been formed in order, the sheet which bears the image whose page number is the smaller is positioned below the sheet which bears the image whose page number is the larger. Due to this, it is possible to store the plurality of sheets of paper, whose image surfaces are facing downwards, by loading them upon the paper ejection tray 38 in the state in which the sequence of their plurality of images is perfect.

It should be understood that it would also be acceptable, when the sort function is selected, for the pages of odd numbered copies as well to be conveyed in the same manner as the pages of the even numbered copies, and for these paper sheets to be discharged from the paper ejection rollers 52 two at a time.

Figure 11:
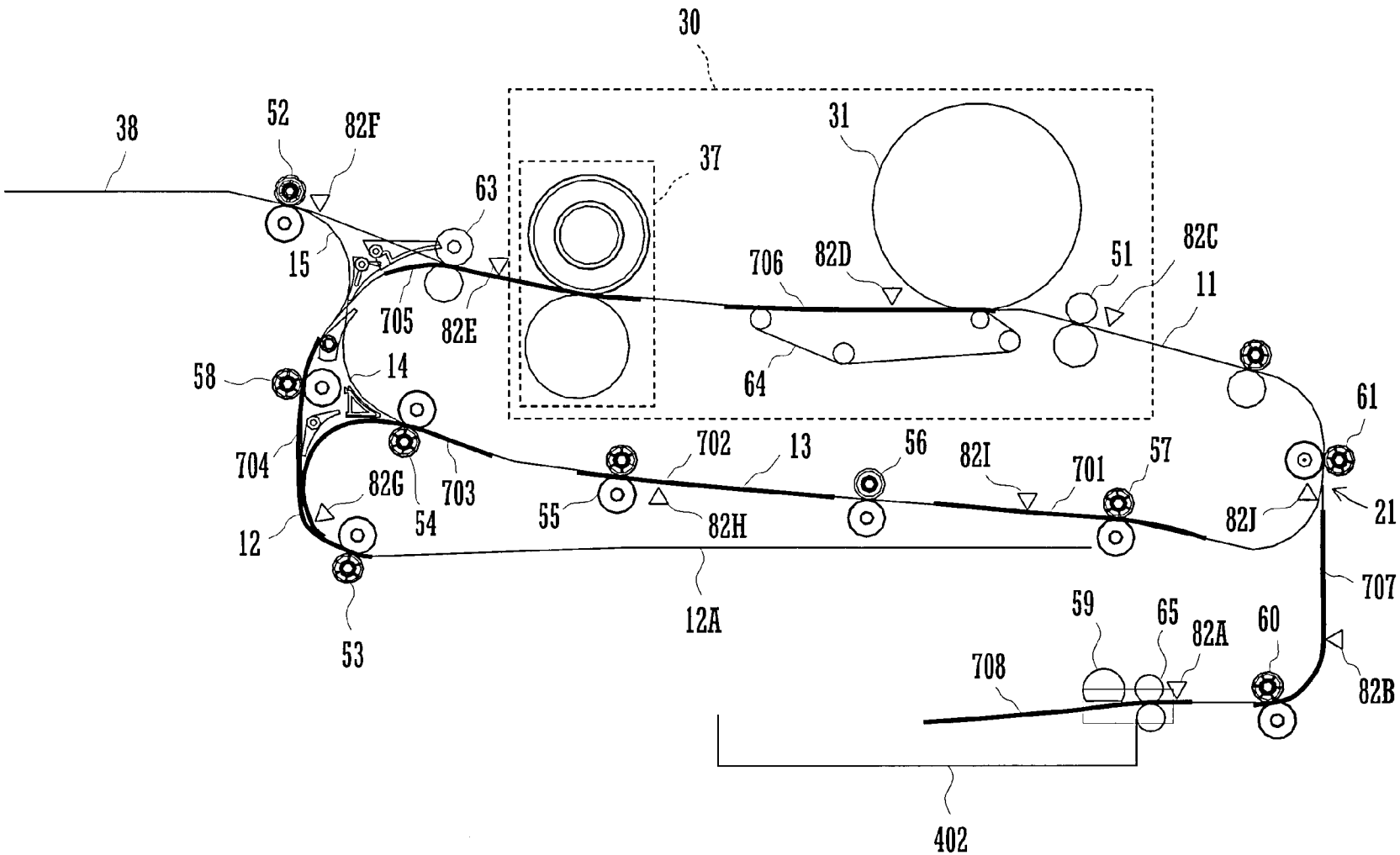
FIG. 11 is a figure showing a state of conveyance of paper during double sided image formation by this image forming apparatus, when the offsetting member of the shifter mechanism is shifted.

FIGS. 10 and 11 are figures showing the state of conveyance of paper during double sided image formation by this image forming apparatus 100. FIG. 10 shows the case in which the offsetting unit 560 of the shifter mechanism 500 is not shifted, while FIG. 11 shows the case in which the offsetting unit 560 of the shifter mechanism 500 is shifted.

During double sided image formation, when the sorting mechanism is not selected, and when a page of an odd numbered copy is being discharged when the sort function is selected, the shifter mechanism 500 does not shift the offsetting unit 560. In this case, after image formation has been performed successively upon the first surface of a predetermined number of sheets of paper, then image formation is performed upon the second surfaces of this predetermined number of sheets of paper, and then these sheets of paper, upon which images have been formed upon both their sides, are discharged one at a time.

Here, this predetermined number of sheets of paper is the number of sheets which can be accommodated in the paper transportation path 1, and, as shown in FIG. 10, in this image forming apparatus 100, it is seven sheets. Accordingly, with this image forming apparatus 100, seven sheets of paper 601 through 607 are taken as being one group, and front surface image formation and rear surface image formation are performed in this order.

For example, when a plurality of images in which the pages are consecutive are to be formed upon both sides of the paper, the images of the odd numbered pages, which are the front surface images for the first surfaces of the sheets of paper 601 through 607, are formed in order by the image forming apparatus 30. The image surfaces of each of the sheets of paper 601 through 607 are inverted while they pass from the first branch off unit 24 and via the second transportation path 12, the switch back transportation path 12A, and the third transportation path 13 in that order, after which they are conveyed to the image forming apparatus 30 for the second time, and the image of the even numbered pages, which are their respective rear surface images, are formed upon their second surfaces. Then these paper sheets 601 through 607 are discharged from the paper ejection rollers 52 into the paper ejection tray 38 one at a time.

By doing this, the seven sheets of paper 601 through 607 upon which image formation has thus been completed are stored in the paper ejection tray 38 in the state in which the pages of this copy are perfectly arranged, with the odd numbered pages facing downwards.

It should be understood that it is possible, before the image formation upon the second surfaces of all of these sheets of paper 601 through 607 is completed, to supply two sheets of paper 608 and 609 which are included in the next group from the paper supply tray 402, and for these sheets of paper 608 and 609 to be made to wait at the upstream side of the first confluence unit 21 in the first transportation path 11. Then the conveyance of the sheet of paper 608 is started at the timing at which the rear end of the final sheet of paper 607 of the previous group, which has been conveyed and has arrived via the third transportation path 13, passes the first confluence unit 21. By doing this, it is possible to contemplate increasing the speed of image formation processing for large numbers of sheets of paper.

During double sided image formation, when the sort function is selected and the pages of an even numbered copy are being discharged, the offsetting unit 560 is shifted by the shifter mechanism 500. In this case, after image formation upon the first surfaces of a predetermined number of sheets of paper has been successively performed, then image formation is performed upon the second surfaces of this predetermined number of sheets of paper, and then these sheets of paper, upon which images have been formed upon both their sides, are discharged two at a time.

Here, this predetermined number of sheets of paper is an even number of sheets of a range which does not exceed the number of paper sheets which can be accommodated in the paper transportation path 1, and, as shown in FIG. 11, in this image forming apparatus 100, it is six sheets. Accordingly, with this image forming apparatus 100, six sheets of paper 701 through 706 are taken as being one group, and rear surface image formation and front surface image formation are performed in this order.

For example, when a plurality of images in which the pages are consecutive are to be formed upon both sides of the paper, then the images of the even numbered pages, which are the respective rear surface images for the first surfaces of the sheets of paper 701 through 706, are formed in order by the image forming apparatus 30. The image surfaces of each of the sheets of paper 701 through 706 are inverted while they pass from the first branch off unit 24 and via the second transportation path 12, the switch back transportation path 12A, and the third transportation path 13 in that order, after which they are conveyed to the image forming apparatus 30 for the second time, and the image of the odd numbered pages, which are their respective front surface images, are formed upon their second surfaces. Then these paper sheets 701 through 706, upon which images have been formed upon both their sides, are discharged from the paper ejection rollers 52 into the paper ejection tray 38 two at a time, by the same processing as performed in the steps S6 through S16 shown in FIG. 7 and by the same processing as performed in the steps S31 through S39 shown in FIG. 8.

By doing this, the six sheets of paper 701 through 706 upon which image formation has thus been completed are stored in the paper ejection tray 38 in the state in which the pages of this copy are perfectly arranged, with the odd numbered pages facing downwards.

It should be understood that it is possible, before the image formation upon the rear surfaces of all of these sheets of paper 701 through 706 is completed, to supply two sheets of paper 707 and 708 which are included in the next group from the paper supply tray 402, and for these sheets of paper 707 and 708 to be made to wait at the upstream side of the first confluence unit 21 in the first transportation path 11.

However, if the conveyance of the sheet of paper 707 is started at the timing at which the rear end of the final sheet of paper 706 of the previous group, which has been conveyed and has arrived via the third transportation path 13, passes the first confluence unit 21, then the sheet of paper 707 is conveyed from the first branch off unit 24 into the second transportation path 12 in the state in which the sheets of paper 705 and 706 are respectively positioned within the second transportation path 12 and the third transportation path 13, so that jamming occurs.

Thus, the timing of starting the conveyance of the sheet of paper 707 which is waiting must be made, at the very earliest, to be a timing after the time point at which the rear end of the sheet of paper 706 passes the registration roller 51, and desirably is made to be the timing at which the rear end of the sheet of paper 706 passes the fixing device 37.

Furthermore, during double sided image formation in which the sort function is selected, if the total number of sheets of paper in one copy after completion of image formation is an odd number, then a sheet of paper upon which neither a single sided image nor a double sided image has been formed is added and conveyed after at least the last sheet of paper of the even numbered copies.

As described above, in this image forming apparatus 100, the third transportation path 13 and the switch back transportation path 12A, which correspond to the "retention unit" of the Claims, along with the branch off claws 41 through 45, the switch back roller 53, and the conveyance rollers 54 and 58, constitute the "paper overlapping mechanism" 600 of the Claims. The branch off claws 41, 43, and 44 respectively correspond to the first through the third "branch off claws" of the Claims, while the switch back roller 53 and the conveyance rollers 54 and 58 correspond to the "bidirectional roller" of the Claims. It should be noted that it would also be possible to incorporate three or more transportation paths in the retention unit of the present invention.

It should be understood that the present invention is not limited in its application to an image forming apparatus, such as the image forming apparatus 100; it could also be implemented in the same manner for a paper processing device which performs some type of processing upon paper, other than image formation processing.

Finally, in the above described explanation of an embodiment of the present invention, all of the features are shown by way of example, and should not be considered as being limitative of the present invention. The scope of the present invention is not to be defined by any of the features of the embodiment described above, but only be the scope of the appended Claims. Moreover, equivalents to elements in the Claims, and variations within their legitimate and proper scope, are also to be considered as being included within the range of the present invention.

What is claimed is:

1. A paper processing device, comprising:

a processing unit which performs predetermined processing upon sheets of paper which are being conveyed one at a time along a paper conveyance direction;

a paper ejection roller which discharges the sheets of paper, after completion of processing by the processing unit, in the paper conveyance direction;

a sorting mechanism which shifts the paper ejection roller to and fro along a rotation shaft between an initial position and a sorting position in a direction which is orthogonal to the paper conveyance direction;

a paper overlapping mechanism which superimposes, between the processing unit and the paper ejection roller in the paper conveyance direction, a predetermined number of sheets of paper upon which processing has been completed; and a control unit which is adapted to control the operation of the sorting mechanism and the paper overlapping mechanism;

wherein the paper overlapping mechanism comprises a plurality of retention units which branch off along the paper conveyance direction from between the processing unit and the paper election roller; and, after each of a plurality of sheets of paper, upon which processing by the processing unit has been completed, has been stored by a corresponding one of the plurality of retention units, they are discharged by each of the plurality of retention units into the paper conveyance direction between the processing unit and the paper election roller as mutually superimposed; and wherein the control unit is adapted to superimpose a predetermined number of sheets of paper by operating the paper overlapping mechanism, before shifting the paper ejection roller from the initial position to the sorting position with the sorting mechanism.

2. The paper processing device according to claim 1, wherein the control unit is adapted, after the paper ejection roller has discharged the predetermined number of sheets of paper superimposed by the paper overlapping mechanism in the sorting position, to shift the paper ejection roller with the sorting mechanism from the sorting position to the initial position, before the next set of the predetermined number of sheets of paper which have been superimposed by the paper overlapping mechanism arrives at the paper ejection roller.

3. A paper processing method, comprising:

a processing process of performing predetermined processing at a processing unit upon sheets of paper which are being conveyed one at a time along a paper conveyance direction;

a discharge process wherein after each of a plurality of sheets of paper, upon which processing by the processing unit has been completed in the processing process, has been stored by a corresponding one of a plurality of retention units, they are discharged by each of the plurality of retention units into a paper conveyance direction between the processing unit and a paper ejection roller as mutually superimposed; and a discharge process of shifting a paper ejection roller to and fro between an initial position and a sorting position in a direction which is orthogonal to the paper conveyance direction, thus discharging a plurality of sheets of paper after completion of processing, sorted into groups, in different positions in the direction which is orthogonal to the paper conveyance direction, and the discharge process wherein after the paper ejection roller has discharged the predetermined number of sheets of paper mutually superimposed by the paper overlapping mechanism in the sorting position, the paper ejection roller is shifted from the sorting position to the initial position, before the next set of the predetermined number of sheets of paper which have been mutually superimposed by the paper overlapping mechanism arrives at the paper ejection roller, wherein, during the discharge process, the predetermined number of sheets of paper are superimposed before shifting the paper ejection roller from the initial position to the sorting position.

4. An image forming apparatus, comprising:

an image formation device which forms images upon sheets of paper which are being conveyed one at a time along a paper conveyance direction;

a paper ejection roller which discharges the sheets of paper, after completion of formation of images thereupon by the image formation device, in the paper conveyance direction;

a sorting mechanism which shifts the paper ejection roller to and fro between an initial position and a sorting position in a direction which is orthogonal to the paper conveyance direction;

a paper overlapping mechanism, between the image formation device and the paper ejection roller in the paper conveyance direction, which superimposes a predetermined number of sheets of paper;

a control unit which is adapted to control the operation of the image formation device, the sorting mechanism and the paper overlapping mechanism; and a re-transportation path and a switch back transportation path along which, during double sided image formation in which images are formed on both sides of the paper, paper sheets upon which images have been formed on one side pass, wherein:

the re-transportation path communicates a first branch off position between the image formation device and the paper ejection roller in the paper conveyance direction with the image formation device via a second branch off position;

the switch back transportation path branches off from the second branch off position and switches back paper sheets; and the paper overlapping mechanism stores two sheets of paper which are to be mutually superimposed between the image formation device and the paper ejection roller in the paper conveyance direction, one in the re-transportation path, and one in the switch back transportation path; and the control unit is adapted to superimpose the predetermined number of sheets of paper by operating the paper overlapping mechanism before shifting the paper ejection roller from the initial position to the sorting position with the sorting mechanism.

5. The image forming apparatus according to claim 4, wherein the control unit is adapted, after the paper ejection roller has discharged the predetermined number of sheets of paper superimposed by the paper overlapping mechanism in the sorting position, to shift the paper ejection roller with the sorting mechanism from the sorting position to the initial position, before the next set of the predetermined number of sheets of paper which have been superimposed by the paper overlapping mechanism arrives at the paper ejection roller.

6. The image forming apparatus according to claim 4, wherein:

the image formation device forms an image upon the upper surface of a sheet of paper which is being conveyed in the paper conveyance direction;

and further comprising a confluence transportation path which inverts the upper and lower surfaces of, and discharges, paper sheets which have been stored in the re-transportation path and the switch back transportation path, at a confluence position between the image formation device and the paper ejection roller in the paper conveyance direction;

and wherein the control unit is adapted to transport the earlier sheet of paper, and the later sheet of paper, among two sheets of paper which are being successively conveyed, respectively in order to the lower transportation path and to the higher transportation path among the re-transportation path and the switch back transportation path, and to operate the paper overlapping mechanism so as to discharge the two sheets of paper from the confluence transportation path at the confluence position.

7. The image forming apparatus according to claim 6, wherein the control unit is adapted, when forming both a front surface image and a rear surface image upon the two sides of paper, to operate the image formation device so as to form the front surface image and the rear surface image in that order upon paper which is being discharged without operating the sorting mechanism, and so as to form the rear surface image and the front surface image in that order upon paper which is being discharged while operating the sorting mechanism.

8. The image forming apparatus according to claim 6, wherein the control unit is adapted, when forming both a front surface image and a rear surface image upon the two sides of a plurality of sheets of paper, to perform image formation of a front surface image and of a rear surface image upon each of a plurality of sheets of paper which have been grouped into groups of the maximum number of sheets of paper which can be accommodated in the re-transportation path and the switch back transportation path.

9. The image forming apparatus according to claim 4, wherein the paper overlapping mechanism further comprises a first branch off claw which selectively opens and closes the re-transportation path direction at the first branch off position, a second branch off claw which selectively opens and closes the switch back transportation path direction at the second branch off position, and a third branch off claw which selectively opens and closes between the switch back transportation path and the confluence transportation path at the second branch off position.

10. The image forming apparatus according to claim 4, wherein the paper overlapping mechanism further comprises bi-directional rollers which selectively transmit bi-directional rotation in the forward rotational direction or the reverse rotational direction to each of the re-transportation path and the switch back transportation path.

* * * * *